US009173433B2

(12) United States Patent
Kuhl et al.

(10) Patent No.: US 9,173,433 B2
(45) Date of Patent: Nov. 3, 2015

(54) TOBACCO SHREDDER WITH DOUBLE-MOUNTED CONVEYOR-WORM SHAFT

(75) Inventors: Volker Kuhl, Bayreuth (DE); Gerald Schmekel, Elmshorn (DE); Dietmar Franke, Bayreuth (DE)

(73) Assignee: British American Tobacco (Germany) GMBH, Hamburg (DE)

( * ) Notice: Subject to any disclaimer, the term of this patent is extended or adjusted under 35 U.S.C. 154(b) by 1849 days.

(21) Appl. No.: 12/517,793

(22) PCT Filed: Aug. 29, 2007

(86) PCT No.: PCT/EP2007/007544

§ 371 (c)(1),
(2), (4) Date: Feb. 18, 2010

(87) PCT Pub. No.: WO2008/067859

PCT Pub. Date: Jun. 12, 2008

(65) Prior Publication Data

US 2010/0139674 A1 Jun. 10, 2010

(30) Foreign Application Priority Data

Dec. 5, 2006 (DE) ..... 10 2006 057 290

(51) Int. Cl.
*A24B 5/16* (2006.01)
*A24B 3/18* (2006.01)
(Continued)

(52) U.S. Cl.
CPC ..... *A24B 3/18* (2013.01); *B30B 11/225* (2013.01); *B30B 11/241* (2013.01)

(58) Field of Classification Search
CPC ..... A24B 3/18; B30B 11/241; B30B 11/225
USPC ..... 131/297, 298, 324, 290, 300, 301; 241/30, 301
See application file for complete search history.

(56) References Cited

U.S. PATENT DOCUMENTS

RE31,631 E * 7/1984 McFarland ..... 241/74
5,366,680 A * 11/1994 Foresman ..... 264/141
(Continued)

FOREIGN PATENT DOCUMENTS

DE 19831334 A1 1/2000
DE 20 2004 019 711 * 4/2005
(Continued)

OTHER PUBLICATIONS

English translation of International Preliminary Report on Patentability issued Aug. 26, 2009, for corresponding International Patent Application No. PCT/EP2007/007544, filed Aug. 29, 2007.
(Continued)

*Primary Examiner* — Richard Crispino
*Assistant Examiner* — Dionne W Mayes
(74) *Attorney, Agent, or Firm* — NW Poulsen

(57) ABSTRACT

The invention relates to a tobacco shredding device with a heatable pressure chamber (3), which has a tobacco material inlet (5) at the low-pressure end, an expansion gap outlet at the pressure end and a shaft-mounted conveyor screw (1) for conveying the tobacco material from the inlet to the outlet, and the conveyor screw shaft (19) is supported at the inlet end, and the shaft (19) extends on behind the outlet, where it is supported again by a counter bearing (17). It further relates to a method of shredding tobacco, whereby the tobacco material is introduced at the low-pressure end of a pressure chamber and is expanded and discharged at the pressure end of the chamber at a gap outlet, and the tobacco material is conveyed from the inlet to the outlet by means of a conveyor screw shaft-mounted at both end portions, and the conveyor screw is operated in a speed range of up to 600 $min^{-1}$.

24 Claims, 2 Drawing Sheets

Figure 1:
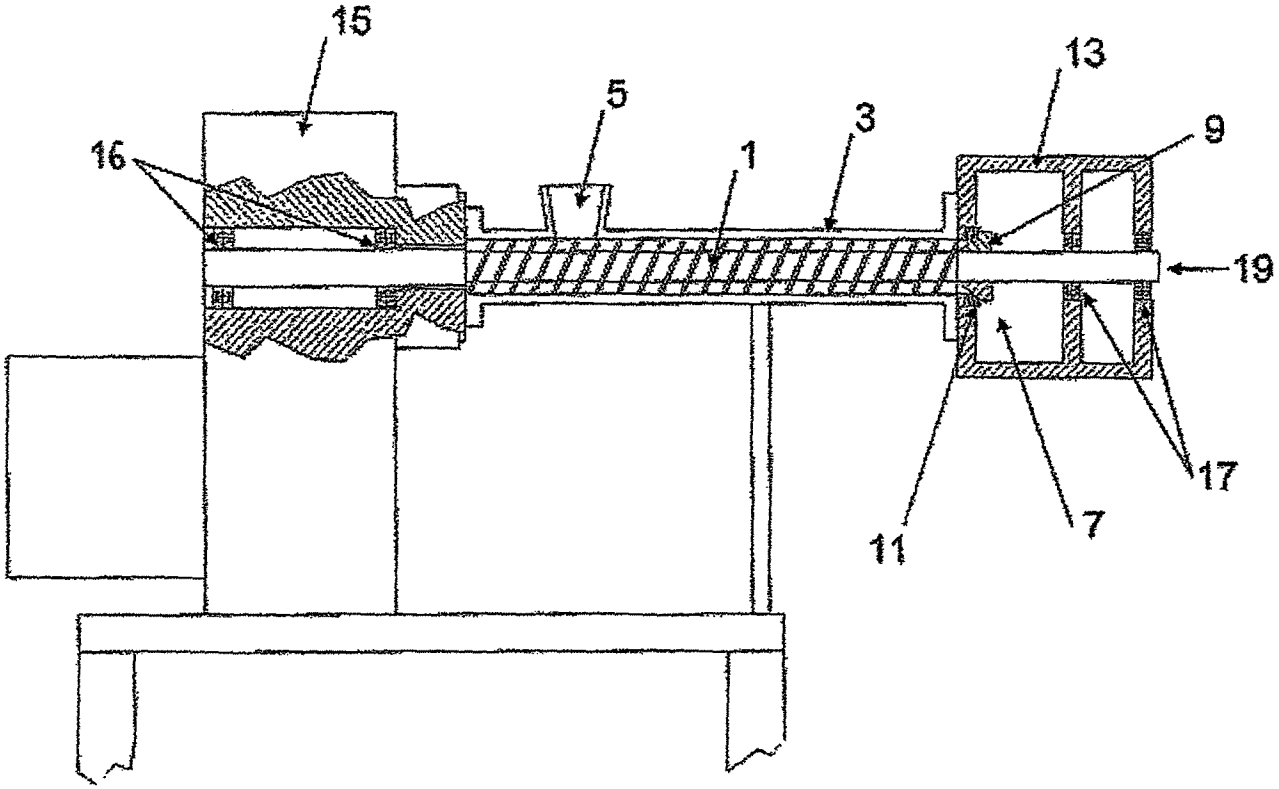

(51) Int. Cl.
*B30B 11/22* (2006.01)
*B30B 11/24* (2006.01)

(56) References Cited

U.S. PATENT DOCUMENTS

| | | | | | |
|---|---|---|---|---|---|
| 5,582,793 | A | * | 12/1996 | Glazer et al. | 422/26 |
| 6,033,205 | A | * | 3/2000 | Chiu | 425/562 |
| 7,934,509 | B2 | * | 5/2011 | Ehling et al. | 131/297 |

FOREIGN PATENT DOCUMENTS

| | | | | |
|---|---|---|---|---|
| DE | 102004059388 | A1 | | 6/2006 |
| FR | 2560817 | A | | 9/1985 |
| GB | 237689 | A | | 8/1925 |
| JP | 2004314130 | A | | 11/2004 |
| SU | 327999 | | * | 3/1972 |
| SU | 327999 | A1 | | 12/1972 |
| WO | WO2006/061117 | A | | 6/2006 |

OTHER PUBLICATIONS

English translation of Written Opinion of the International Searching Authority issued Jun. 5, 2009, for corresponding International Patent Application No. PCT/EP2007/007544, filed Aug. 29, 2007.

International Search Report dated Dec. 7, 2007, for corresponding International Patent Application No. PCT/EP2007/007544, filed Aug. 29, 2007.

* cited by examiner

TOBACCO SHREDDER WITH DOUBLE-MOUNTED CONVEYOR-WORM SHAFT

CLAIM FOR PRIORITY

This application is a National Stage Entry entitled to and hereby claims priority under 35 U.S.C. §§365 and 371 corresponding to PCT Application No. PCT/EP2007/007544, titled, "TOBACCO SHREDDER WITH DOUBLE-MOUNTED CONVEYOR-WORM SHAFT," filed Aug. 29, 2007, which in turn claims priority to German Application Serial No. DE 10 2006 057 290.4, filed Dec. 5, 2006, all of which are hereby incorporated by reference.

The invention relates to the technical field of tobacco shredding. In particular, it relates to the technical field of producing cut tobacco material by shredding, and more specifically, the tobacco rib material is shredded using the invention so that a product with quite particularly advantageous properties is obtained, which can ultimately be used for the production of smokers' articles.

It has proved to be of advantage to shred tobacco materials because a very high quality product can be produced from the initial material, for example from rib material, and its structure is not far behind that of cut tobacco in terms of quality. Pressure shredding is very efficient, enables a high material yield and produces unique products.

Patent specification DE 10 2004 059 388 discloses a tobacco shredding device of the generic type, which has a heatable pressure chamber, which in turn has a tobacco material inlet at the low-pressure end, an expansion gap outlet at the pressure end and a shaft-mounted conveyor screw shaft for conveying the tobacco material from the inlet to the outlet. The conveyor screw shaft is support at the inlet end and extends to just short of the outlet, where it lies in a free-bearing arrangement in the chamber. During normal operation, the conveyor screw is relatively well centred with the aid of the product flowing through the pressure chamber. In operating states when there is no or little product in the pressure chamber, however, the free-standing end of the conveyor screw shaft sits inside on the pressure chamber housing, which causes lead-in scoring in the housing when the system is started up and results in increased wear on the shaft, for example.

The objective of the invention is to overcome the above-mentioned disadvantages of the prior art. In particular, a tobacco shredding device and a tobacco shredding method are proposed, which function optimally in all operating modes.

This objective is achieved on the basis of a tobacco shredding device as defined in claim 1 and a method as defined in claim 12. The dependent claims define preferred embodiments of the invention.

As proposed by the invention, the conveyor screw shaft of the device extends on behind the outlet, where it is provided with another support in the form of a counter bearing. In other words, in the region of the outlet, the conveyor screw shaft is centred and brought to a halt by providing a bearing at both ends of the pressure chamber. The advantage of providing more than one bearing in this manner is that it guarantees the stability of the shaft position, including in the outlet region, and does so in all operating modes; this reduces wear and increases service life and reliability. Surprisingly, however, other advantages are also obtained, which have a direct bearing on production. For example, it has been demonstrated in experiments that devices proposed by the invention make it possible to achieve very much higher material throughput rates than is the case with the prior art when using identical expansion gap outlets. This will be explained in more detail below.

As proposed by the invention, said counter bearing may be fixed relative to the pressure chamber and as a result, the shaft can also be centred relative to the pressure chamber by the counter bearing, and in particular relative to the outlet which is mounted on the pressure chamber so as to be stationary, i.e. precisely at the most crucial point. In a preferred embodiment, the counter bearing is disposed on an outlet head, which adjoins the pressure chamber and is secured to its outlet end.

One advantageous embodiment of the invention is characterised by the fact that the gap outlet is restricted by a first outlet part secured to the pressure chamber or to the outlet head, and a second outlet part is seated on the shaft so as to rotate in unison with it. This design also offers major advantages and may also be regarded as a separate invention or a separate purpose of the invention. Devices based on the prior art effectively have two separate shafts, one for the conveyor screw and one for a part of the gap outlet, because these two elements do not sit on a common shaft. In view of the fact that manufacturing tolerances always exist, these two shafts are not actually oriented with respect to one another and this causes increased wear of the die, in other words the outlet parts, if the gap distances are short. However, if, as is the case based on the aspect of the invention described above, the second outlet part sits on the conveyor screw shaft so as to rotate in unison with it, the centred orientation of the second outlet part (die part) is achieved by definition (even in the event of very short gap distances), thereby making it possible to use shorter gap distances.

The second outlet part may be secured in different axial positions of the shaft in order to adjust the gap size, or it is possible to opt for anther alternative embodiment in which the second outlet part is able to slide axially in order to adjust the gap size and is mounted on the shaft in a fixed arrangement by means of displacement mechanisms. The first outlet part may form an outer part of the gap outlet, whereas the second outlet part forms an inner part of the gap outlet. In one special design, the gap of the gap outlet is an annular gap, more especially a conical gap, in which case the outer part specifically has an inner cone and the inner part has a co-operating outer cone. The outer part and inner part advantageously move relative to one another, and more specifically in the case of the embodiment proposed above, it is naturally the second outlet part which moves because it rotates in unison with the shaft.

In the case of one embodiment of the invention, gap sizes are in a range of from 0.01 mm to 2 mm, in particular in the range of from 0.1 mm to 0.5 mm. This offers the possibility of designing the gap walls so that they are roughened or have profiling, in particular ridged or cross-ridged profiled regions, which are preferably disposed transversely to the direction in which the gap wall moves and in particular have a depth of up to 3 mm.

Speeds of from 0 to 600 $min^{-1}$ can be achieved with the invention if the drive and bearing and counter bearing of the device (conveyor screw shaft) are designed accordingly.

During the method proposed by the invention for shredding tobacco, the tobacco material is introduced from the low-pressure end of a pressure chamber and is expanded and discharged at a gap outlet at the pressure end of the chamber, and the tobacco material is conveyed from the inlet to the outlet by means of a conveyor screw shaft-mounted at the two end portions, and the conveyor screw is operated in a speed range of up to 600 $min^{-1}$.

The speed range for the operating speed may essentially start at one of the following values: 50 $min^{-1}$, 100 $min^{-1}$, 150 $min^{-1}$, 200 $min^{-1}$, 250 $min^{-1}$. It may also essentially end at one of the following values: 300 $min^{-1}$, 350 $min^{-1}$, 450 $min^{-1}$, 500 $min^{-1}$, 550 $min^{1}$. Intermediate values are also possible and the choice will depend on which device is used and the desired input and output parameters.

In the respective embodiments, the method proposed by the invention is essentially operated on the basis of at least one of the following parameters:

- initial moisture of the tobacco material: 6%-30%, more especially 9-12%;
- pressure in the chamber: 5-120 bar; more especially 40-80 bar;
- chamber temperature: 90-180°; more especially 130° C.-150° C.;
- final moisture of the tobacco material: 8%-25%; more especially 13%-16%.

Figure 2:
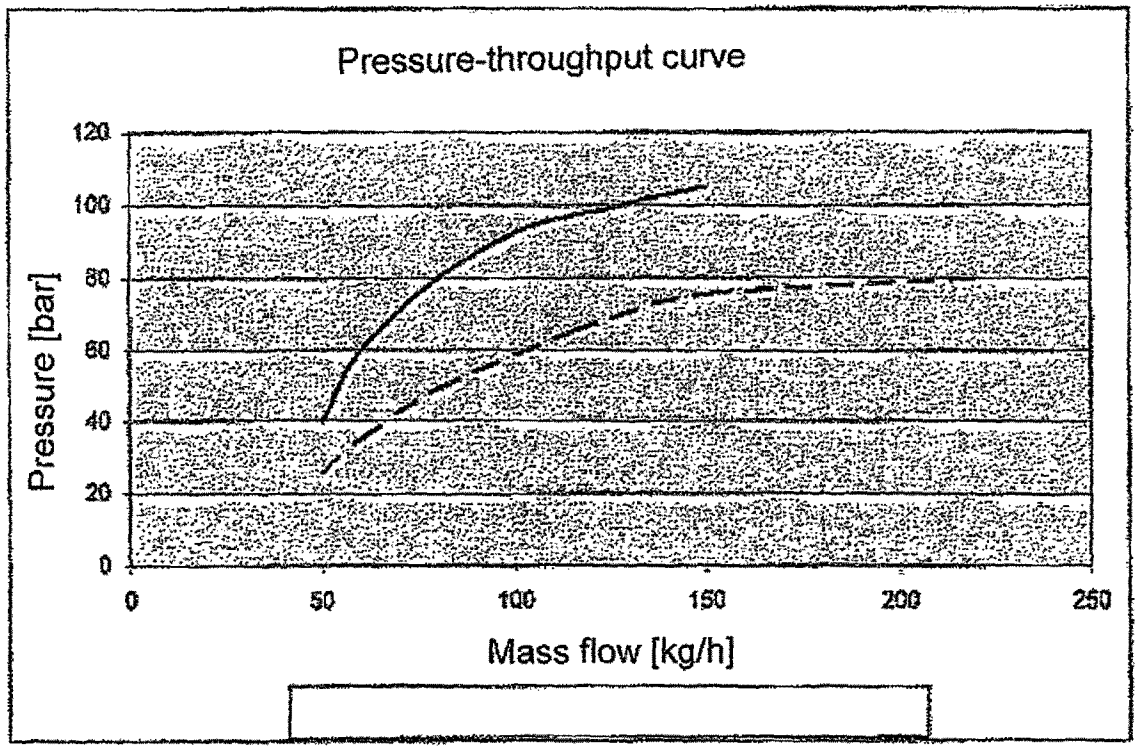

The invention will be explained in more detail below with reference to embodiments. All the features described may be used both individually and in any practical combination. Of the appended drawings:

FIG. 1 is a longitudinal section through a tobacco shredding device proposed by the invention; and FIG. 2 is a diagram plotting pressure as a function of throughput rate for the device proposed by the invention and a device based on the prior art.

In the embodiment illustrated in FIG. 1, a conveyor screw 1 seated on a shaft 19 is accommodated in a tube 3, which serves as a pressure chamber. The conveyor screw 1 and the shaft 19 may be parts of an integral piece which differ solely in terms of their function; alternatively, they may be made up of or assembled from several pieces or parts. The tobacco material can be introduced into the tube 3 through the inlet 5, and the tobacco material is conveyed towards the die 7 mounted on the outlet of the tube by the rotating movement of the conveyor screw 1. The die 7 comprises an inner cone 11 (outer part or first outlet part), i.e. a hollow cone. The second outlet part or also the inner part is formed by the cone 9 and this cone 9 is mounted on the shaft 19 so as to rotate in unison with it. A gap outlet is formed between the tapering wall of the cone 9 and the internal wall of the inner cone 11.

The inner cone 11 of the die 7 is secured in an outlet head 13 which, like the transmission housing 15 disposed at the inlet end, has bearings 17, which serve as a counter bearing as proposed by the invention. The bearings of the transmission housing 15 are denoted by reference 16. The counter bearing 17 provides support for the common shaft 19, which supports the conveyor screw 1 and also the cone 9.

In the embodiment of the device illustrated here, the die 7 has a gap which is adjustable but which is set at the start of production, for example by fixing the cone 9 at a specific axial point of the shaft 19 using conventional means. A design of this type is of advantage if the operating parameters are known exactly and have been tried and tested and it is not necessary to change the gap width during production.

Within the scope of this invention, however, it would also be possible to mount the cone 9 on the shaft 19 so that it slides and can be fixed, and can be so to enable the gap width to be selectively varied during production. A slide seating as well as a hydraulic cylinder power transmission may be selected for this purpose, for example, which either opposes a second hydraulic cylinder or opposes a spring mounting.

In both cases, however, the shaft 19 and hence the conveyor screw 1 and cone 9 are very efficiently centred by the counter bearing 17, thereby largely reducing or preventing wear as proposed by the invention.

Surprisingly, it was found during experimental tests with devices proposed by the invention that higher material throughput rates could be achieved using identical cone geometries.

The reason for this is as follows: the higher the rotation speed of the cone 9, the smaller the drop in pressure. At a higher speed of rotation, the dynamic pressure on the cone 9 rises, thereby reducing jamming of the tobacco material in the ridges. In this situation, the effective free cross-section is bigger than it is if the cone 9 is rotating at a lower speed.

Another possible explanation is better shredding. Accordingly, the viscosity of the conveyed and shredded tobacco material is increased at the decisive point, namely the annular gap, thereby improving throughput.

In addition, reduced torques during shredding mean less energy consumption and are gentler on the dies. The rotation speed in devices known from the prior art is limited to low values in the range of approximately 50 $min^{-1}$. The device proposed by the invention with the shaft mounted at more than one point enables rotation speeds of up to 300 $min^{-1}$, in particular even up to 600 $min^{-1}$, to be achieved without any perceptible increase in wear.

A significant increase in the throughput rate of the material can be expected if using the optimised device proposed by the invention, as illustrated in FIG. 2. It plots the material throughput rates as a function of the pressure needed for systems with a shaft mounted at more than one point (broken lines) and systems with a shaft mounted at one end based on the prior art (solid line). With the parameters otherwise identical but at an increased speed, a maximum device performance of ca. 225 kg/h throughput was achieved on the basis of the invention compared with ca. 150 kg/h based on the prior art. Another positive aspect is that the mechanical pressures needed are also significantly lower.

The invention claimed is:

1. A tobacco shredding device, comprising:

a pressure chamber having:

a tobacco material inlet at a low-pressure end, an expansion gap outlet at a pressure end, and a shaft-mounted conveyor screw configured to convey the tobacco material from the tobacco material inlet to the expansion gap outlet, wherein the conveyor screw shaft is supported at the tobacco material inlet end, and is supported behind the expansion gap outlet by means of a counter bearing, and wherein the expansion gap outlet is defined by a first outlet part and a second outlet part, the first outlet part being secured either to the pressure chamber or to an outlet head adjoining the pressure chamber, the second outlet part being seated on the shaft to rotate in unison with the shaft and fixable at different axial positions on the shaft to adjust a width of the expansion gap, wherein walls of the expansion gap outlet have at least one of roughening, ridged profiling, and/or cross-ridged profiling.

2. The tobacco shredding device as claimed in claim 1, wherein the pressure chamber is configured to be heated.

3. The tobacco shredding device as claimed in claim 1, wherein the counter bearing is fixed relative to the pressure chamber.

4. The tobacco shredding device as claimed in claim 1, wherein the counter bearing is disposed on the outlet head.

5. The tobacco shredding device as claimed in claim 1, wherein the second outlet part is mounted so that it is configured to slide axially in order to adjust the expansion gap width and is fixed on the shaft by displacement mechanisms.

6. The tobacco shredding device as claimed in claim 1, wherein the first outlet part forms an outer part and the second outlet part forms an inner part of the expansion gap outlet.

7. The tobacco shredding device as claimed in claim 1, wherein the gap is an annular gap, wherein the annular gap is a conical gap, wherein the first outlet part forms an outer part and the second outlet part forms an inner part of the expansion gap outlet, wherein the outer part has an inner cone and the inner part has a co-operating outer cone.

8. The tobacco shredding device as claimed in claim 1, wherein the expansion gap width is in a range of from 0.01 mm to 2 mm.

9. The tobacco shredding device as claimed in claim 1, further comprising a drive, a bearing supporting the conveyor screw shaft at the tobacco material inlet, and the counter bearing, wherein the drive, the bearing and the counter bearing are configured to operate at conveyor screw shaft rotational speeds of from o to 600 $min^{-1}$.

10. The tobacco shredding device as claimed in claim 1, wherein the expansion gap width is in a range of 0.1 mm to 0.5 mm.

11. The tobacco shredding device as claimed in claim 1, wherein the profiling of a wall of the expansion gap is disposed transversely to a direction in which that wall of the expansion gap is configured to move.

12. The tobacco shredding device of claim 1, wherein the profiling of a wall of the expansion gap has a depth of up to 2-3 mm.

13. A tobacco shredding device, comprising:

a pressure chamber housing having a tobacco material inlet at a low-pressure end thereof, a first outlet part and a second outlet part defining an expansion gap outlet at a pressure end of the pressure chamber housing, a shaft, and a shaft-mounted conveyor screw within the housing, the shaft-mounted conveyor screw configured to convey tobacco material from the tobacco material inlet to the expansion gap outlet, the expansion gap outlet having walls with at least one of roughening, ridged profiling and/or cross-ridged profiling, the first outlet part secured either to the pressure chamber housing or to an outlet head adjoining the pressure chamber housing, the second outlet part seated on the shaft and configured to rotate in unison with the shaft and to be adjustably positionable at different axial positions on the shaft to adjust a size of the expansion gap outlet, and the shaft supported by a bearing at the tobacco material inlet and by a counter bearing behind the expansion gap outlet.

14. A method of shredding tobacco, comprising:

introducing tobacco material at a low-pressure end of a pressure chamber, the pressure chamber having a tobacco material inlet at the low-pressure end, an expansion gap outlet at a pressure end distal the low-pressure end, and a conveyor screw shaft, wherein the conveyor screw shaft is supported at the tobacco material inlet end, and is supported behind the expansion gap outlet by a counter bearing, wherein the expansion gap outlet is defined by a first outlet part and a second outlet part, the first outlet part secured either to the pressure chamber or to an outlet head adjoining the pressure chamber, the second outlet part seated on the conveyor screw shaft to rotate in unison with the conveyor screw shaft and fixable at different axial positions thereon to adjust a width of the expansion gap outlet, wherein the expansion gap outlet includes at least one wall with at least one of roughening, ridged profiling and/or cross-ridged profiling;

conveying the tobacco material from the low-pressure end of the pressure chamber to the expansion gap outlet by the conveyor screw shaft, wherein the conveyor screw operated in a rotational speed range of up to 600 $min^{-1}$, and expanding and discharging the tobacco material from the pressure chamber at the expansion gap outlet.

15. The method as claimed in claim 14, wherein the speed range of the operating rotational speed approximately starts at one of the following values: 50 $min^{-1}$, 100 $min^{-1}$, 150 $min^{-1}$, 200 $min^{-1}$, 250 $min^{-1}$.

16. The method as claimed in claim 14, wherein the speed range of the operating rotational speed approximately ends at one of the following values: 300 $min^{-1}$, 450 $min^{-1}$, 500 $min^{-1}$, 550 $min^{-1}$.

17. The method as claimed in claim 14, wherein initial moisture of the tobacco material is approximately 6% to 30%.

18. The method as claimed in claim 14, wherein a pressure in the chamber is 5-120 bar.

19. The method as claimed in claim 14, wherein chamber temperature is approximately 90° C.-180° C.

20. The method as claimed in claim 14, wherein final moisture of the tobacco material is approximately 8%-25%.

21. The method as claimed in claim 14, wherein initial moisture of the tobacco material is approximately 9% to 12%.

22. The method as claimed in claim 14, wherein chamber temperature is approximately 130° C.-150° C.

23. The method as claimed in claim 14, wherein final moisture of the tobacco material is approximately 13%-16%.

24. The method as claimed in claim 14, wherein a pressure in the chamber is 40-80 bar.

* * * * *